US006571967B2

(12) United States Patent
Belokin et al.

(10) Patent No.: US 6,571,967 B2
(45) Date of Patent: Jun. 3, 2003

(54) DISPLAY SHELF WITH PRODUCT ANCHORS

(76) Inventors: Paul Belokin, 7801 I-35 North, Denton, TX (US) 76202; Martin P. Belokin, 7801 I-35 North, Denton, TX (US) 76202; Norman P. Belokin, 1606 Oak Ridge Dr., Corinth, TX (US) 76205

( * ) Notice: Subject to any disclaimer, the term of this patent is extended or adjusted under 35 U.S.C. 154(b) by 0 days.

(21) Appl. No.: 09/845,476

(22) Filed: Apr. 30, 2001

(65) Prior Publication Data

US 2002/0158032 A1 Oct. 31, 2002

(51) Int. Cl.[7] ..... A47G 29/00

(52) U.S. Cl. ..... 211/71.01; 211/90.01; 211/88.01; 211/89.01

(58) Field of Search ..... 211/71.01, 75, 211/74, 88.01, 90.01, 85.18, 89.01; D6/574; 248/206.3, 206.4

(56) References Cited

U.S. PATENT DOCUMENTS 1,634,953 A * 7/1927 McCune et al. ..... 211/74
2,467,873 A * 4/1949 Weir ..... 211/74
2,491,652 A * 12/1949 Feerick ..... 211/90.01
2,741,913 A * 4/1956 Dovas ..... 73/61.65
3,220,558 A * 11/1965 Olsson ..... 211/74
4,326,761 A * 4/1982 Schwartz ..... 312/326
4,479,584 A * 10/1984 Raz ..... 211/89.01
4,984,693 A * 1/1991 Belokin, Jr. et al. ..... 211/88.01
5,096,272 A * 3/1992 Belokin, Jr. et al. ..... 312/129
5,330,261 A * 7/1994 Bennett ..... 312/321.5
5,913,433 A * 6/1999 Belokin et al. ..... 211/90.01

* cited by examiner

*Primary Examiner*—Robert W. Gibson, Jr.
*Assistant Examiner*—Khoa Tran
(74) *Attorney, Agent, or Firm*—Jack A. Kanz

(57) ABSTRACT

A display shelf which employs a support panel for attachment to one face of a transparent wall, a horizontally extending floor to support cylindrically shaped products adjacent the transparent wall; and a containment wall which extends upwardly from the floor and spaced horizontally from the transparent wall is provided with anchors which prevent rotation of the cylindrically shaped product. The containment wall cooperates with the floor to support and orient cylindrically shaped products vertically adjacent the supporting wall. Anchors extending from the containment wall toward the transparent wall urge the vertically oriented cylindrically shaped products against the transparent wall and prevent the products from rotating about their vertical axes.

6 Claims, 2 Drawing Sheets

DISPLAY SHELF WITH PRODUCT ANCHORS

This invention relates to display of cylindrically shaped products and product containers such as food and candy packages, bottles, cans, tubes and the like. More particularly, it relates to display racks or shelves adapted for mounting on a transparent wall to support the products on and display the products through the transparent wall.

Retail businesses commonly display chilled products on a shelf or rack mounted inside a refrigerated vault or other enclosed area which has a transparent door or wall panel. Because a passing customer is more likely to select and purchase products displayed where they can be readily seen and recognized, the retailer desires to maximize visibility of products on display and also to maximize utilization of space within the vault area.

Many products are essentially elongated cylinders or packaged in substantially cylindrically shaped containers such as bottles, tubes, cans and the like. To promote sales of such products, they should be arranged to permit unobstructed view of the displayed products as well as advertising and identification marks such as brands, logos or the like displayed on the product containers. When such products are suspended on the inside of a door or the like of a refrigerated compartment, they should also be arranged to permit unobstructed view of other products in the refrigerated compartment as well.

In accordance with the present invention a display shelf is provided which employs a vertically arranged support panel for mounting the shelf adjacent a transparent wall or the like. The support panel supports a floor which extends horizontally in a plane intersecting the vertical plane of the support panel. A containment wall spaced horizontally from the transparent wall defines a plurality of semi-circular or arcuate wall sections which cooperate with the floor to support and arrange cylindrically shaped products vertically adjacent the transparent wall. Anchors in the form of resilient tongues or bosses extend from the containment wall toward the transparent wall to urge the cylindrically shaped products toward and into firm contact with the transparent wall. The anchors secure the cylindrically shaped product firmly against the transparent wall to assure that the product is visible through the transparent wall and to prevent rotation of the product about its vertical axis. Preventing rotation of the cylindrical product about its vertical axis assures that product will remain in the position in which it is originally placed for display. Thus, when a product is arranged on the display shelf with a preferred display face visible through the transparent wall, the product will remain in its original position regardless of movement of the transparent wall or the removal or addition of other products from or to the shelf. Maintaining the displayed product firmly adjacent the transparent wall also improves visibility of the product through the transparent wall.

In the preferred embodiment the display shelf is supported on the inside face of a substantially transparent wall, such as a glass door or the like, with the containment wall comprised of arcuate sections spaced from the inside face of the transparent wall. Anchors extending inwardly from each arcuate section in the containment wall secure the product placed within each arcuate section firmly against the transparent wall. The products are thus prevented from rotation and maintained firmly against the transparent wall so that the face adjacent the transparent wall is clearly visible through the transparent wall. Other features and advantages of the invention will become more readily understood from the following detailed description taken in connection with the appended claims and attached drawing in which:

Figure 1:
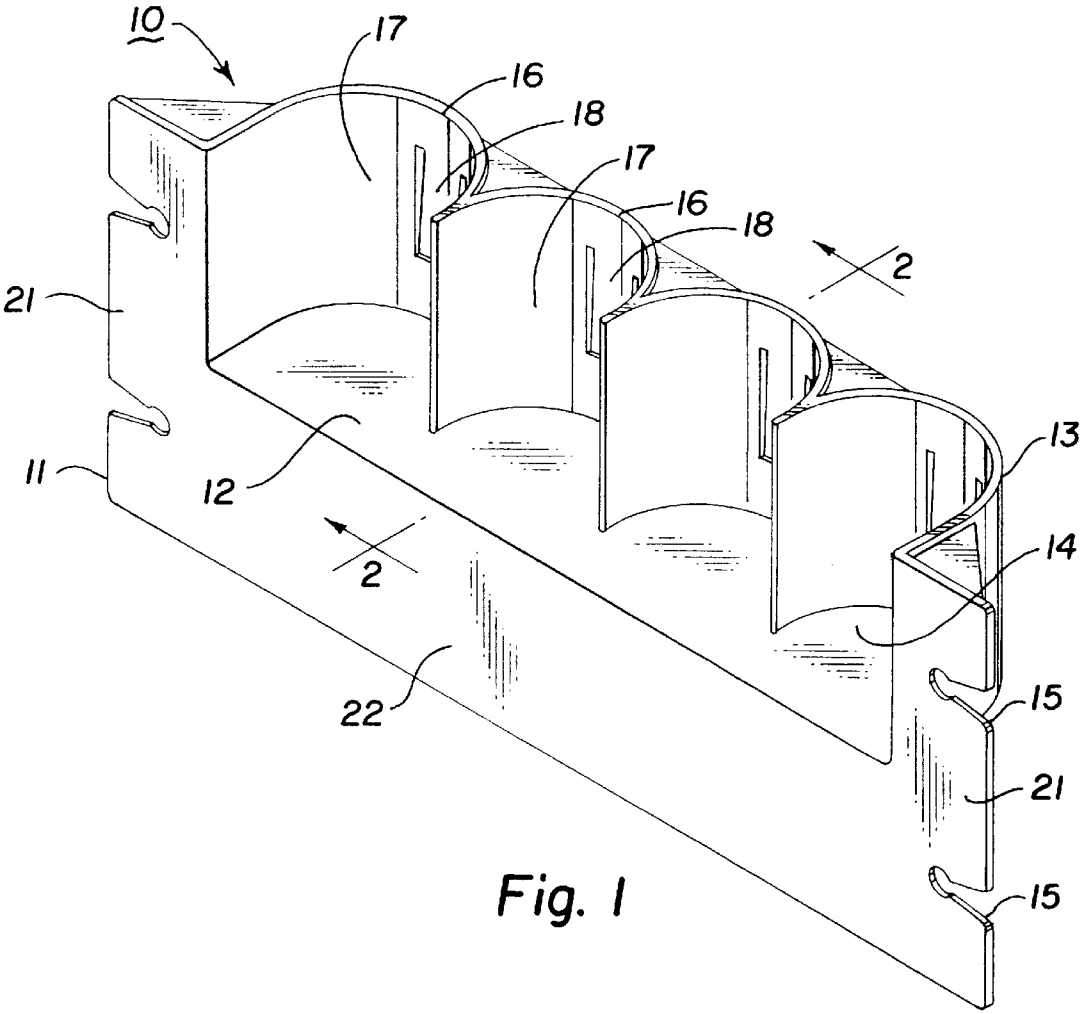
FIG. 1 is a front perspective view of a display shelf with product anchors in accordance with the invention.
Figure 2:
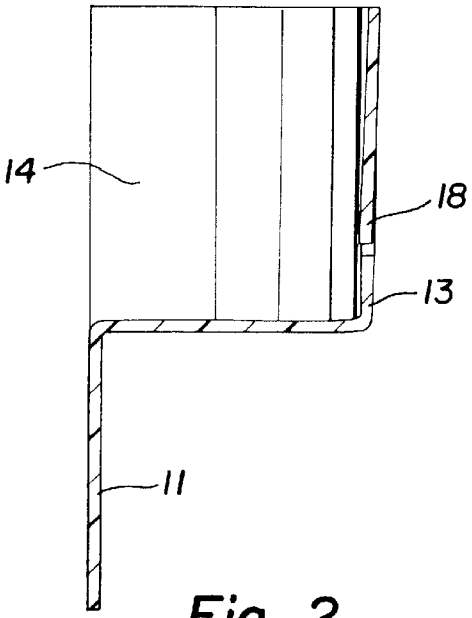
FIG. 2 is a sectional view of the display shelf of FIG. 1 taken through line 2—2.

The drawing is incorporated into and forms part of the disclosure of this specification to illustrate exemplary embodiments of the invention. Throughout the several views of drawing like reference numerals designate corresponding elements. The figures are not to scale but are intended to disclose the inventive concepts by illustration. It will be recognized that the principles of the invention may be utilized and embodied in many and various forms. In order to demonstrate these principles, the invention is described herein by reference to specific preferred embodiments. The invention, however, is not limited to the forms illustrated and described. Furthermore, the invention is not limited to use in connection with display of retail products but may find utility in other similar applications.

For purposes of this disclosure, the term "transparent wall" is used to mean any substantially vertically extending panel which is substantially transparent. Similarly, "shelf" and "rack" are used to mean any structure used to support and display product.

In FIG. 1 the invention is illustrated as a rack or shelf 10 adapted to be mounted on the wall or door of a compartment such as a refrigerated vault or the like. It will be readily appreciated that the invention is not limited to use on a door or to use in a refrigerated vault. The principles of the invention are equally applicable to use in a shelf supported adjacent any substantially transparent wall such as a window, door or the like, whether or not the transparent wall is moveable. In certain applications the supporting wall need not be transparent.

The shelf 10 shown in FIG. 1 comprises a support panel 11 extending in a substantially vertical plane which supports a floor 12 extending in a substantially horizontal plane and containment wall 13 which extends upwardly from floor 12. The containment wall 13 is spaced horizontally from the vertical plane of the support panel 11 to cooperate with floor 12 and any wall on which the shelf 10 is mounted to form a compartment for products to be displayed.

Figure 3:
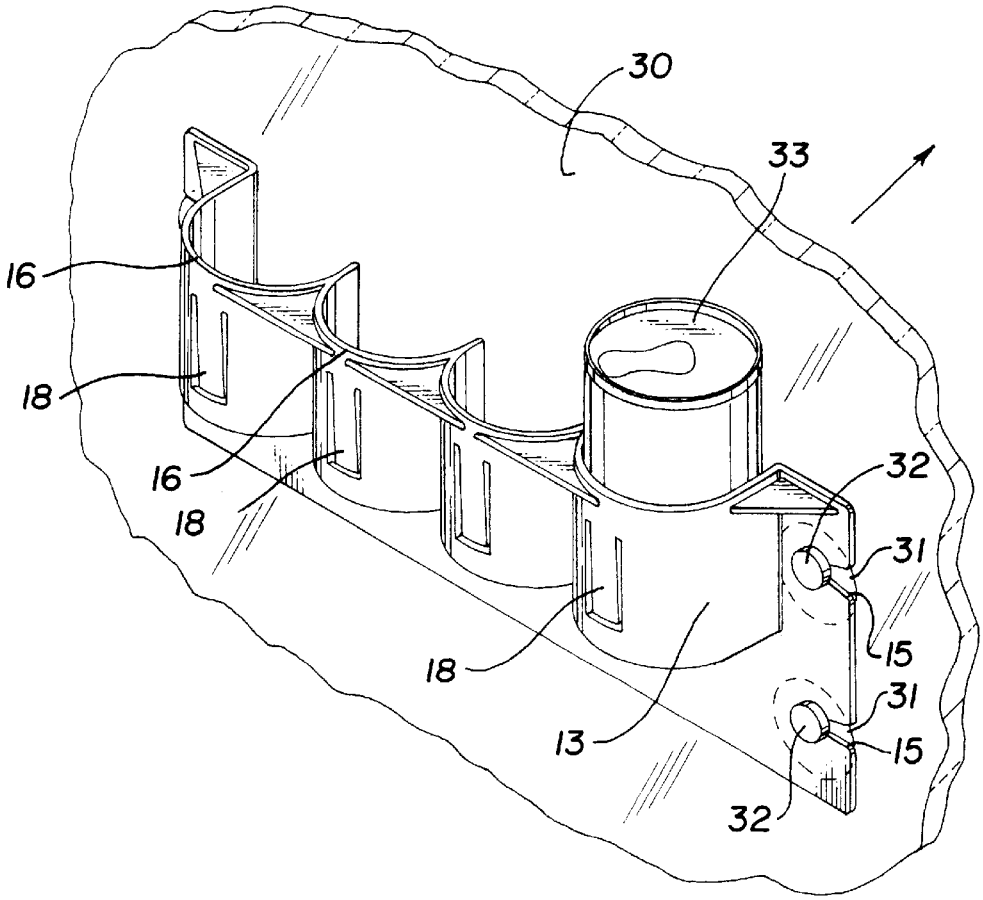
FIG. 3 is a rear perspective view of the display shelf of FIG. 1 mounted on a transparent door or the like and supporting a cylindrical product adjacent the transparent door.

The support panel 11 is configured so that it defines an open area 14 directly above the floor 12 between the containment wall 13 and the plane of support panel 11 so that product placed on the floor 12 may be positioned directly adjacent the wall on which shelf 10 is to be mounted. Means such as slots 15 are formed in or otherwise provided for mounting support panel 11 to a supporting wall 30 or the like as shown in FIG. 3. As shown in the drawing, support panel 11 is configured to provide parallel vertical subpanels 21 which include the mounting slots 15 and a connecting horizontal panel 22 which extends the full width of the support panel 11 below floor 12. In this configuration the front face of support panel 11 may be mounted adjacent a wall 30 or the like (as illustrated in FIG. 3) so that floor 12 and containment wall 13 cooperate with the wall 30 to define a cavity, compartment or multiple compartments or the like for supporting product adjacent wall 30.

In the preferred embodiment the containment wall 13 comprises a plurality of vertically extending arcuate or semi-circular sections 16, each of which cooperates with the floor 12 and wall 30 to define a compartment 17 for supporting and displaying in a substantially cylindrically shaped product. Compartments 17 need not be fully enclosed and arcuate sections 16 need not be joined to form a continuous containment wall 13. It is only necessary that the sections 16 cooperate with the floor 12 and wall 30 to define a compartment or cavity which supports product on floor 12. If desired, the size, shape, location and orientation of each of sections 16 may be selected to accommodate a particular pre-determined product.

As illustrated in FIG. 3 the shelf 10 is mounted on wall 30 using suction cups 31, each with a stem 32 extending through a slot 15. Other means, such as adhesives and the like, may be used instead of or in conjunction with suctions cups 31. In the embodiment illustrated, horizontal panel 22 is positioned directly below floor 12 with its front face adjacent wall 30. Accordingly, advertising material may be displayed on horizontal panel 22, if desired, which will be visible through supporting wall 30 if wall 30 is transparent.

In the preferred application wall 30 is a substantially transparent panel such as a glass door, wall or the like. In order to best display product or product containers through the transparent wall, the product is placed on the shelf with its most preferred display face oriented toward the wall 30. As illustrated in FIG. 3 the product comprises a beverage can 33. Accordingly, to best display the product in a shelf 10 supported on a transparent wall 30 the beverage can 33 is placed on floor 12 with its major or preferred display face oriented toward wall 30 (in the direction of the arrow in FIG. 3).

Where wall 30 is a moveable panel such as a door or the like, or where the product displayed in shelf 10 is otherwise subject to disturbing forces such as removal and/or addition of other products, substantially cylindrical or cylindrically shaped products and product containers tend to rotate about their vertical axes. Such rotation, of course, moves the most desireable or preferred display face of the product or product container away from the wall 30. To prevent such rotation, and to insure that the preferred display face is readily visible through wall 30, containment wall 13 is provided with anchor means which extends from the containment wall 13 toward wall 30. The anchor means resiliently urges the product against the supporting wall 30, thus trapping the product against wall 30 to prevent accidental movement of the displayed product while maintaining the most desireable display face against the inside face of transparent supporting wall 30.

In the embodiment illustrated the anchor comprises a finger 18, one end of which is secured to the containment wall 13 with the opposite end extending into the compartment 17 toward the plane of the support panel 11. The anchor, of course, can take any or various forms. It may, for example, be merely a bump or boss on the containment wall 13 which extends toward the plane of the support panel 11. It is only necessary that the anchor, in whatever form, comprise means which allows product to be readily placed on and removed from the floor 12 of the shelf 10 but which urges the product toward the plane of support panel 11 and into contact with the wall 30 on which the shelf 10 is supported.

As illustrated in the drawing, shelf 10 is formed as a unitary monolithic body by injection molding or the like. Accordingly, support panel 11, floor 12, containment wall 13 and anchor fingers 18 are formed as integral parts of a monolithic unit. However, it will be readily recognized that shelf 10 may be formed by individual components either attached to each other or spaced from each other to define compartments 17. In the preferred embodiment, shelf 10 is formed of transparent acrylic or the like. Any suitable material, however, may be used.

In the embodiment illustrated slots 15 are used to mount the shelf 10 on a supporting wall 30 by use of suction cups 31 or the like as shown in FIG. 3. Alternatively, the shelf may be secured to a supporting wall by other means such as adhesives or the like or, where the supporting wall 30 is appropriately constructed, by screws, bolts or the like.

While the invention is primarily designed to maintain cylindrically shaped products with their preferred display faces adjacent a transparent wall so that the preferred display face is visible through the supporting transparent wall, it may be utilized in other applications. For example, the shelf 10 may be mounted on the outside of a door or on any other wall, transparent or not. In such applications, the preferred display face on the product such as beverage can 33 would be oriented in the opposite direction (opposite the arrow in FIG. 3) and the anchors 18 would prevent rotation of the product about its vertical axis so that the preferred display face remains in its original position.

It will be apparent from the foregoing that the principles of the invention may be used to form display shelves for various substantially cylindrically shaped products such as bottles, cans, tubes and the like which anchor the product firmly adjacent the supporting wall or the like on which the display shelf is mounted. It is to be understood that even though numerous characteristics and advantages of the invention have been set forth in the foregoing description together with details of the structure and function of the invention, this disclosure is to be considered illustrative only. Various changes and modifications may be made in detail, especially in matters of shape, size, arrangement and combination of parts, without departing from the spirit and scope of the invention as defined by the appended claims.

What is claimed:

1. An integrally formed monolithic shelf unit for supporting and displaying cylindrically shaped products adjacent one face of a supporting wall comprising:

(a) a support panel having a first face which defines an upper edge and a lower edge lying in a substantially vertical plane;

(b) a floor having a top face lying in a substantially horizontal plane substantially normal to and intersecting said substantially vertical plane;

(c) a containment wall extending upwardly from said floor and spaced horizontally from the vertical plane of said support panel, said containment wall comprising a plurality of arcuate sections, each defining a portion of a compartment for maintaining a vertically oriented cylindrically shaped product on said floor between said containment wall and the substantially vertical plane of said support panel; and (d) an anchor extending from at least one of said arcuate sections toward the vertical plane of said support panel.

2. A shelf as defined in claim 1 wherein said anchor is in the form of a resilient finger which has a first end joined to said arcuate section and a second end which extends downwardly toward said floor and inwardly toward said substantially vertical plane of said support panel.

3. In combination:

(a) a substantially transparent support wall having a substantially vertically extending first face; and (b) a display shelf for supporting and displaying cylindrically shaped products adjacent said first face of a said substantially transparent support wall comprising:

(i) a support panel having a first face which defines an upper edge and a lower edge lying in a substantially vertical plane;

(ii) a floor having a top face lying in a substantially horizontal plane substantially normal to and intersecting said substantially vertical plane;

(iii) a containment wall extending upwardly from said floor and spaced horizontally from the vertical plane of said support panel, said containment wall comprising a plurality of arcuate sections, each defining a portion of a compartment for maintaining a vertically oriented cylindrically shaped product on said floor between said containment wall and the substantially vertical plane of said support panel; and (iv) an anchor extending from at least one of said arcuate sections toward the vertical plane of said support panel.

4. A combination as defined in claim 3 wherein said anchor is in the form of a resilient finger which has a first end joined to said arcuate section and a second end which extends downwardly toward said floor and inwardly toward said substantially vertical plane of said support panel.

5. A combination as defined in claim 3 wherein said anchor is in the form of a boss formed in said arcuate section.

6. A combination as set forth in claim 3 wherein said support wall is a door.

* * * * *